US006072131A

United States Patent [19]

Dorey

[11] Patent Number: 6,072,131

[45] Date of Patent: Jun. 6, 2000

[54] DEVICE FOR THE ACTUATION OF AT LEAST ONE SWITCH WITH REINFORCED SAFETY

[75] Inventor: Michel Dorey, Saint Paul les Romans, France

[73] Assignee: Crouzet Automatismes, Valence, France

[21] Appl. No.: 09/031,550

[22] Filed: Feb. 27, 1998

[30] Foreign Application Priority Data

Feb. 28, 1997 [FR] France ..... 97 02437

[51] Int. Cl.[7] ..... H01H 1/52

[52] U.S. Cl. ..... 200/318; 200/1 B

[58] Field of Search ..... 200/329, 332, 200/335, 327, 556, 555, 6 A, 47

[56] References Cited

U.S. PATENT DOCUMENTS 2,330,646 9/1943 Voigt et al. .
2,791,664 5/1957 Rohacs .
3,198,922 8/1965 Rohacs .
3,700,835 10/1972 Rackson .
4,551,660 11/1985 Suzuki ..... 318/293
5,736,703 4/1998 Kim ..... 200/1 B

FOREIGN PATENT DOCUMENTS 34 17 726 A1 11/1985 Germany .

*Primary Examiner*—Lincoln Donovan
*Assistant Examiner*—Nhung Nguyen
*Attorney, Agent, or Firm*—Oblon, Spivak, McClelland, Maier & Neustadt, P.C.

[57] ABSTRACT

A device for the actuation of at least one main switch, includes a lever having two main faces. In a working position of the lever, its main face is designed to actuate the main switch. In an idle position of the lever, its second main face is designed to actuate at least one ancillary switch capable of delivering an item of information on the idle position.

14 Claims, 4 Drawing Sheets

DEVICE FOR THE ACTUATION OF AT LEAST ONE SWITCH WITH REINFORCED SAFETY

BACKGROUND OF THE INVENTION

1. Field of the Invention

The present invention relates to a device for the actuation of at least one switch with reinforced safety.

This switch is designed especially to be mounted in a housing such as an operating handle which may be, for example, on board an aircraft and especially in a helicopter, and may be used as a control handle. The switch is designed to control an element of the aircraft. This operating handle may be used in a flight simulator or in a video game or in a ground vehicle.

A handle of this kind generally comprises a body generally adapted to the ergonomic requirements of a hand and, in addition to the actuating device of one or more switches, it may possibly have one or more pushbuttons controlling various elements. It may be tilted in various positions.

2. Description of the Prior Art

A standard actuation device is shown in FIGS. 1*a* and 1*b*. It has a pivoting lever 1 which the operator actuates between two stable positions. This actuation may be done by means of the operator's thumb and index finger. The lever has two main faces 8, 9, namely a first active face 8 and a second inactive face 9.

In a first position of the lever 1, called a working position, its first main face 8 gets applied to the control element 3 or pushbutton for one or more switches 4 housed in the body 2 of the handle 10. This position is illustrated in FIG. 1*a*. By pressing the lever 1, the operator can turn the switches 4 on or off. In this position, the lever 1 is shown as being pointed in a substantially vertical direction. After pivoting by about 270°, its second main face 9 rests on the body 2 of the handle 3. FIG. 1*b* shows this configuration. The lever 1 is shown as being directed substantially horizontally in FIG. 1*b* and lies in a hollow 5 of the handle 10. This position of the lever 1 is said to be an idle position.

In the two figures, the lever 1 is also shown in an intermediate position between the idle position and the working position.

For reasons of safety, the switches 4 cannot be actuated directly by the operator's finger. The pushbuttons 3 for the switches 4 form no projection outside the body 2 of the handle 10. The lever 1 is fitted out on its first main face 8, which is active in the working position, with projecting pads 6 designed to actuate the pushbuttons 3. A collapsible spring-based mechanism or pump 7 may be interposed between a pad 6 and a pushbutton 3. This pump 7, which is known to those skilled in the art, makes it possible to overcome problems related to the travel of the pushbutton and the force that is applied to it, in order to be sure of putting the switch into action without damaging it. The travel of the pushbutton must be precise: it should not be too short or too long and the force should be moderate so that the actuation is reliable.

It has been observed that the actuation of a switch of this kind could be a source of insecurity. In flight, the pilot has his hand permanently on the piloting handle and he is the only one who can take account of the position of the lever and especially of the idle position. This knowledge is generally tactile. No other person can acquire this information reliably, because the operator's hand, placed on the handle, prevents the lever from being seen.

To improve the safety of the handling operation, the present invention is aimed at bringing about a sharing of this information. This sharing can be done with the copilot who may, as the case may be, take action in the event of failure on the part of the pilot. This sharing can also be done with a computer that carries out flight management and can combine this information with other pieces of information to authorize or not authorize the pilot to undertake a particular action, for example to tilt the handle in one direction or another to begin a new stage of flight, actuate one of the pushbuttons or even actuate the lever to put it in the working position. In the fields of simulation or games, the computer used may also need this information.

SUMMARY OF THE INVENTION

To improve operating safety, the present invention proposes a device for the actuation of at least one main switch of the lever type, enabling the delivery of reliable information on the idle position of the lever.

For this purpose, the actuation device comprises a pivoting lever with two main faces wherein, in a position called a working position, its first main face is designed to actuate the switch known as the main switch and, in a position called an idle position, its second main face is designed to actuate at least one ancillary switch capable of delivering a piece of information on this idle position.

The lever is relatively light and can pivot freely. To improve the safety of actuation, it is possible to provide for a two-part magnetic device that holds a lever in the idle position. One of the parts may be a magnet on the lever and the other part may be an element made of magnetic material carried by a body in which the main switch is housed or vice versa.

With a view to improving safety, it is also possible that at least one of the switches is capable of being activated only by the lever, this switch then comprising a pushbutton housed within the body and the lever being fitted out with a pad acting on the pushbutton. A spring-based mechanism is placed between the pad and the pushbutton of the switch.

It is possible that the lever, in the working position, will actuate, in addition to the main switch, at least one additional switch. In this configuration, the first main face of the lever comprises an actuation zone for the main switch and at least one actuation zone for the additional switch. These actuation zones are located at different distances from the pivot of the lever.

The lever, main switch and additional switch may be configured so that the main switch and additional switch can be actuated at different points in time or, on the contrary, simultaneously.

The present invention also relates to a switch that can be actuated by a device of this kind and a handle comprising a switch of this kind.

BRIEF DESCRIPTION OF THE DRAWINGS

Other features and advantages of the present invention are explained in detail in the following description of particular embodiments made with reference to the appended figures, of which.

MORE DETAILED DESCRIPTION

Figure 2A:
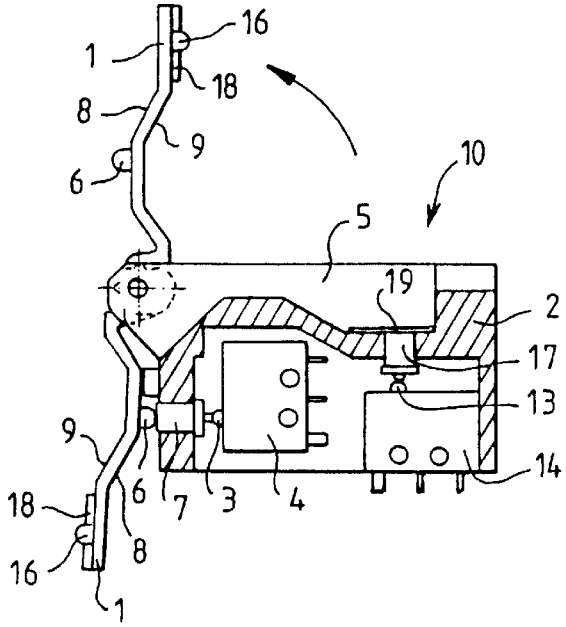
FIGS. 2*a* and 2*b* show an actuation device according to the invention whose lever is respectively in the working position and in the idle position.
Figure 2B:
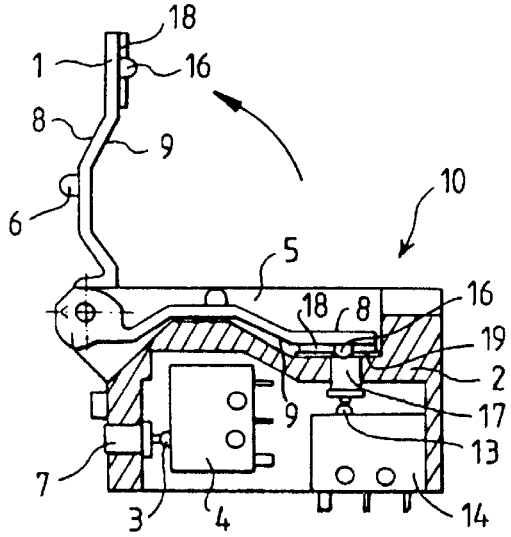
Figure 2C:
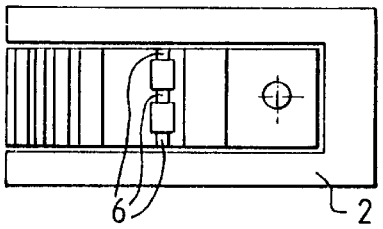
FIGS. 2*c* and 2*d* respectively show a top view and a left-hand view of the actuation device according to the invention.
Figure 2D:
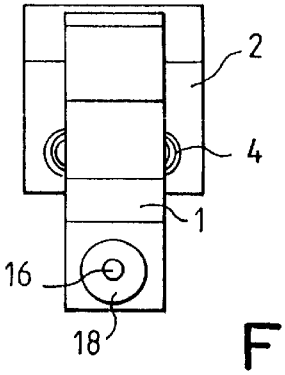

FIGS. 2*a* and 2*b* provide schematic views of an embodiment of a device for the actuation of at least one switch according to the invention with a lever respectively in the working position and in the idle position. FIGS. 2*c* and 2*d* show the same device in a top view and in a left-hand view in the working position.

Figure 1A:
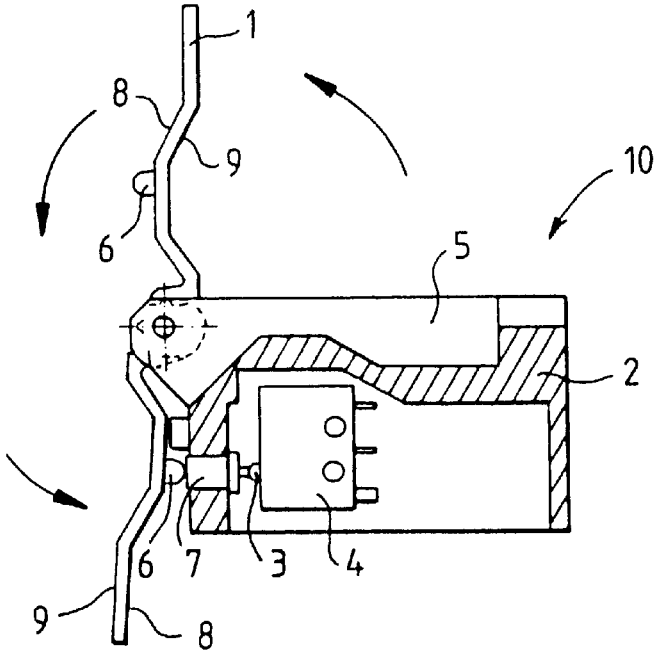
FIGS. 1*a* and 1*b*, already described, show a known type of actuating device whose lever is respectively in the working position and in the idle position.
Figure 1B:
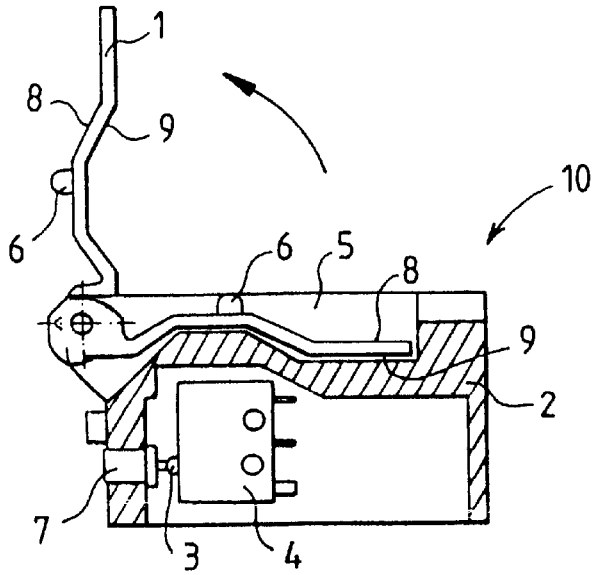

As in FIGS. 1*a* and 1*b*, the lever 1 is shown with its two main faces 8, 9 the first face 8 of which is used to actuate one or more main switches 4 when the lever 1 is in a working position. These main switches 4 are placed in a housing 10 which here too may be the body 2 of an operating handle. Pumps 7 form the interface between the pads 6 of the lever and the pushbuttons 3 of the main switches 4. It is assumed in the example described that the first main face 8 of the lever 1, in its working position, is designed for the simultaneous actuation of three main switches 4 placed side by side.

According to one characteristic of the invention, the second main face 9 of the lever 1 is designed to actuate at least one ancillary switch 14 when the lever is in the idle position. This ancillary switch 14 delivers an electrical signal that may be used as needed. In the field of helicopter piloting, for example, this signal may be used by the on-board computer which will make use of it for example to establish priorities among several forms of action to be performed by the pilot or to give him prohibitory messages. This electrical signal may quite simply activate an element, for example a light indicator, especially for the copilot.

The ancillary switch 14 is housed in the body 2 of the handle 10. In this application, it is also preferable, in order to avert any undesired action, that the pushbutton 16 of the ancillary switch 14 should not be capable of being actuated directly by a finger of the person operating the handle 10. For this purpose, it is planned on, on the side corresponding to the second main face 9 of the lever 1, to have a pad 16 designed to penetrate the body 2 of the handle 10 to act on its pushbutton 13 which is housed in the body 2.

For safety reasons, it is also preferable to provide for a pump 17 between the pad 16 and the pushbutton 13 of the ancillary switch 14.

FIG. 2*c* shows three pads 6 on the side corresponding to the first main face 8 of the lever 1. This corresponds to three main switches 4 placed side by side. In FIG. 2*d*, it can be seen that the actuation zone designed to actuate the main switches 4 is substantially in the central part of the lever. This depiction is only a non-restrictive example.

The lever is generally made of plastic material or aluminum and it can be actuated with relative ease for its pivoting takes place freely. The pilot can make the lever pivot from its idle position to its working position accidentally, and then clench the handle rigidly, thus actuating the switches by mistake. This action may be detrimental if it activates an untimely phase of flight. It is possible to provide for a magnetic device 18, 19 that holds the lever 1 in an idle position. The magnetic device may comprise a magnet 18 on the lever 1, on the side corresponding to its main second face 9, and a part made of magnetic material 19 on the body 2 as in FIGS. 2*a*, 2*b* or conversely a magnet 19 on the body 2 and a magnetic part 19 on the lever 1 on the side corresponding to the main second face 9. This variant is shown partially in FIG. 3.

Figure 3:
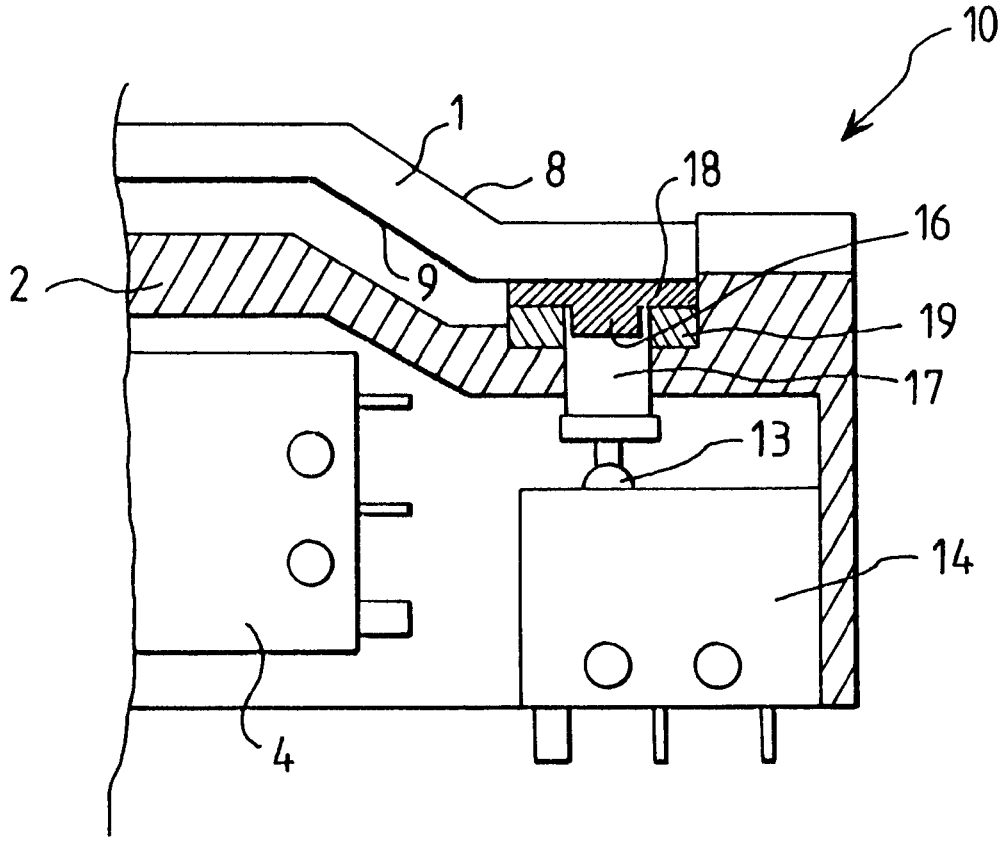
FIG. 3 shows another embodiment of an actuation device according to the invention.

In FIGS. 2*a*, 2*b*, the magnet 18 has the shape of a washer and is crossed by the pad 16. The magnetic part 19 also has the shape of a washer. The magnetic part 19 and the magnet 18 attract each other and, when they adjoin each other, the pad 16 can actuate the ancillary switch 14 by means of the pump 17. In FIG. 3, the metal part 19 is formed with a pad 16 designed to actuate the ancillary switch 14 by means of the pump 17. The magnet 18 also has the shape of a washer. The thicknesses and positions of the magnet 18 and the magnetic part 19 are adapted to the travel of the ancillary switch 14.

If need be, the main first face 8 of the lever 1 may be designed to actuate at least one additional switch 24 in addition to the main switch 4. This main first face 8 may have several actuating zones 26, 36 located at different distances L1, L2 from the pivot 40 of the lever 1.

Figure 4:
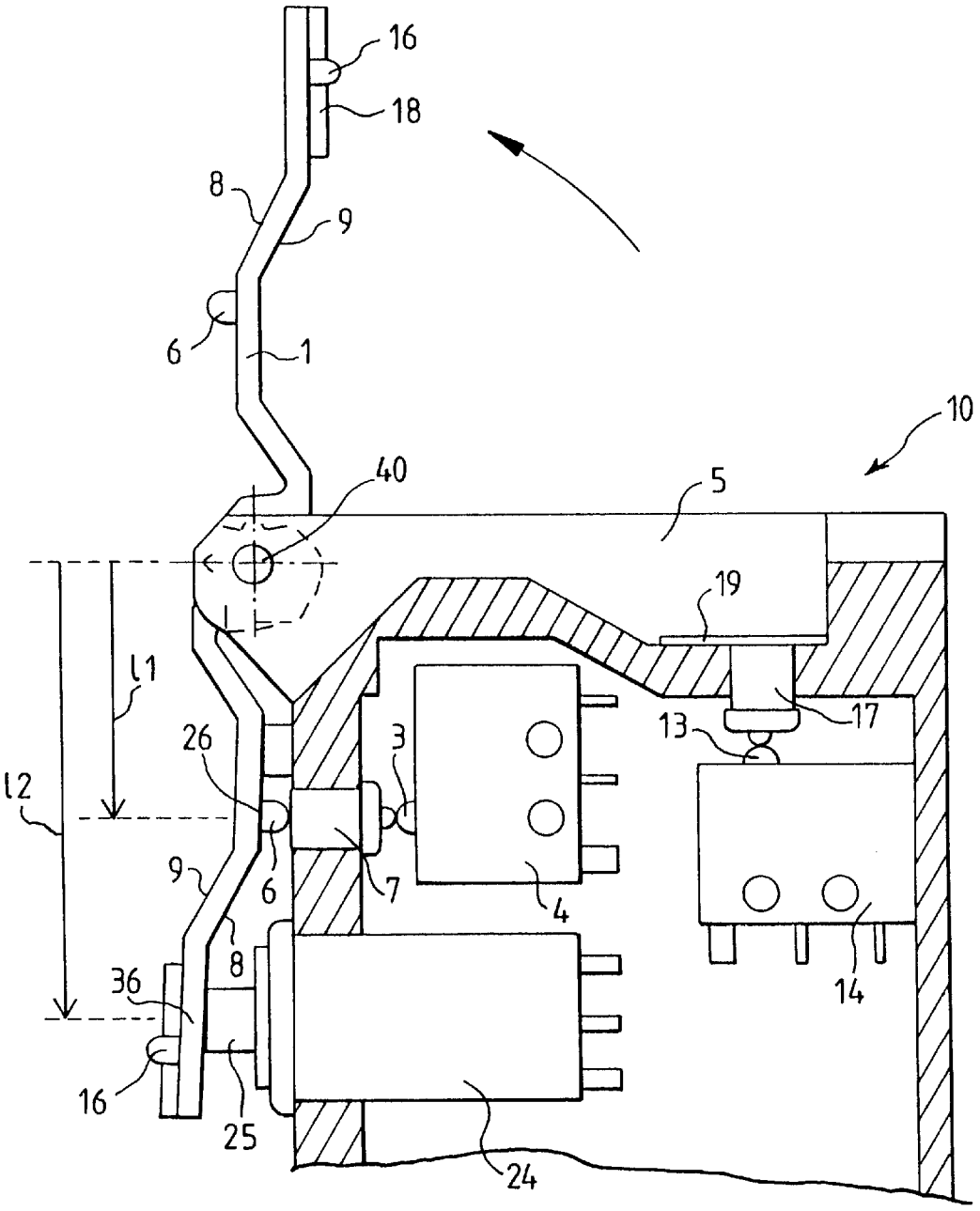
FIG. 4 shows yet another embodiment of an actuation device according to the invention.

In FIG. 4, it is assumed that the lever 1, in the working position, actuates firstly a group of three main switches 4 placed side by side and secondly an additional switch 24 that is at a greater distance from the pivot 40 of the lever 1 than the main switches 4. This configuration enables the use of different types of switches which, as the case may be, may trip at different points in time or simultaneously if the configuration of the lever is appropriate. The additional switch 24 is shown as being bigger than the main switches 4 and the lever 1 is designed to activate its pushbutton 25 directly. Here, no pump is planned. In FIG. 4, the lever 1 has curves that contribute to a situation where the additional switch 24 trips before the main switches. The reverse can be envisaged by modifying the position of the main switches and/or of the additional switch and/or the shape of the lever 1.

In this configuration, the lever 1 has a first actuating zone 26 with several pads 6 to actuate the main switches 4 located at a distance I1 from the pivot 40 of the lever 1 and a second actuating zone 36 without a pad, this second actuating zone being designed for the actuation of the additional switch 24 located at a distance I2 from the pivot 40 of the lever 1. The two distances I1, I2 are different.

The additional switch 24 may also be actuated alone without the lever (the lever being folded down) for a function having a different safety level or to display an element on a screen for example.

The different variants shown are not restrictive. It would have been possible to provide for a pump to actuate the additional switch and not to provide for a pump at the main switch or the ancillary switch.

What is claimed is:

1. A device for actuating at least one switch, comprising:

a housing; and a lever configured to rotate about a pivot and relative to the housing, between a working position and an idle position, the lever including a first main face configured to engage a first portion of the housing when the lever is in the working position to actuate a main switch, and a second main face behind the first main face and configured to engage a second portion of the housing when the lever is in the idle position to actuate an ancillary switch, the ancillary switch being configured to output information corresponding to the idle position.

2. An actuation device according to claim 1, further comprising:

a two-part magnetic device configured to hold the lever in the idle position.

3. A device according to claim 2, wherein the housing comprises:

a body that houses the main switch, wherein one of the parts of the two-part magnetic device is a magnet borne by the lever and the other part is an element made of magnetic material borne by the body.

4. A device according to claim 2, wherein the housing comprises:

a body that houses the main switch, wherein one of the parts of the two-part magnetic device is an element made of magnetic material borne by the lever and the other part is a magnet borne by the body.

5. A device according to claim 1, wherein the first main face of the lever comprises:

an actuation zone for the main switch and at least one other actuation zone for at least one additional switch, the two actuation zones being located at different distances from the pivot of the lever.

6. An actuating device according to claim 5, wherein the lever, the main switch and the additional switch are configured so that the main and additional switches are actuated at different points in time.

7. An actuating device according to claim 5, wherein the lever, the main switch and the additional switch are configured so that the main and additional switches are actuated simultaneously.

8. A device according to claim 1, wherein the lever has an end fixed to the housing, the lever being configured to pivot about the end fixed to the housing.

9. A device according to claim 8, wherein the lever pivots over 180 degrees between the working position and the idle position.

10. A device according to claim 1, wherein the lever has a first end and a second end, the first main face and the second main face are closer to the second end than the pivot, and the pivot is closer to the first end than the first main face and the second main face.

11. A device for actuation of at least one main switch comprising a pivoting lever having two main faces, the lever having a working position in which its first main face is designed to actuate the main switch and an idle position, wherein, in the idle position, its second main face is designed to actuate at least one ancillary switch configured to deliver information about the idle position, wherein the lever, on one of the first and second main faces, has at least one pad configured to actuate a pushbutton of one of the main switch, the ancillary switch, and an additional switch.

12. A device according to claim 11, wherein the pad is borne by one of the two parts of the two-part magnetic device, on the second main surface of the lever.

13. A switch adapted to be actuated by a device according to any of claims 2-11, 12, and 1.

14. An operation handle comprising a switch according to claim 13.

* * * * *